US006981604B2

(12) United States Patent
Iizuka et al.

(10) Patent No.: US 6,981,604 B2
(45) Date of Patent: Jan. 3, 2006

(54) SYNTHETIC RESIN CONTAINER HAVING A BODY WITH CONCAVED PORTION FOR GRIPPING AND ABSORBING DISTORTION OF THE BODY

(75) Inventors: Takao Iizuka, Koto-Ku (JP); Masaaki Sasaki, Matsudo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 206 days.

(21) Appl. No.: 10/399,387

(22) PCT Filed: Dec. 20, 2000

(86) PCT No.: PCT/JP00/09028

§ 371 (c)(1),
(2), (4) Date: May 20, 2003

(87) PCT Pub. No.: WO02/49926

PCT Pub. Date: Jun. 27, 2002

(65) Prior Publication Data

US 2004/0050851 A1 Mar. 18, 2004

(51) Int. Cl.
*B65D 1/02* (2006.01)
*B65D 1/42* (2006.01)
*B65D 23/10* (2006.01)

(52) U.S. Cl. ..... 215/381; 215/384; 220/666; 220/669; 220/675

(58) Field of Classification Search ..... 215/379–384, 215/396, 398; 220/669, 771, 666, 675
See application file for complete search history.

(56) References Cited

U.S. PATENT DOCUMENTS

| | | | | | |
|---|---|---|---|---|---|
| 4,375,442 | A * | 3/1983 | Ota et al. | 264/458 |
| 4,804,097 | A * | 2/1989 | Alberghini et al. | 215/384 |
| 4,993,565 | A * | 2/1991 | Ota et al. | 215/384 |
| 5,064,081 | A * | 11/1991 | Hayashi et al. | 215/373 |
| 5,199,587 | A * | 4/1993 | Ota et al. | 215/381 |
| 5,226,550 | A * | 7/1993 | Mikolaitis et al. | 215/384 |
| 5,261,543 | A * | 11/1993 | Ugarelli | 215/375 |
| 5,392,937 | A * | 2/1995 | Prevot et al. | 215/400 |
| 5,472,105 | A * | 12/1995 | Krishnakumar et al. | 215/384 |
| 5,758,790 | A * | 6/1998 | Ewing, Jr. | 215/384 |
| D402,896 | S * | 12/1998 | Conrad | D9/543 |
| 6,223,920 | B1 * | 5/2001 | Lane et al. | 215/384 |
| 6,439,413 | B1 * | 8/2002 | Prevot et al. | 215/381 |

FOREIGN PATENT DOCUMENTS

JP A 8-318953 12/1996

(Continued)

*Primary Examiner*—Sue A. Weaver
(74) *Attorney, Agent, or Firm*—Oliff & Berridge, PLC

(57) ABSTRACT

A bottle-shaped container made of synthetic resin including a body that has a left side and a right side which are symmetric to each other to a central axis line of the container, wherein each of the left and right sides is formed in a region including a center of the body, with a concaved portion for absorbing distortion due to changes of an internal pressure of the container, the concaved portions in the right and left sides are conformable in shape each other, and have same dimensions, and wherein the container can be held surely with safeness by holding the approximately central portion of the body of the container with fingers and a palm of a single hand from either the front side or the rear side even if the container has a large content and a heavy weight.

9 Claims, 3 Drawing Sheets

FOREIGN PATENT DOCUMENTS

| | | |
|---|---|---|
| JP | A 10-203520 | 8/1998 |
| JP | A 10-305823 | 11/1998 |
| JP | A 10-329820 | 12/1998 |

* cited by examiner

SYNTHETIC RESIN CONTAINER HAVING A BODY WITH CONCAVED PORTION FOR GRIPPING AND ABSORBING DISTORTION OF THE BODY

BACKGROUND OF THE INVENTION

The present invention relates to a cylindrical container of a large volume (e.g., a content of approximately 2 liters) having a long cylindrical body and formed by blow-molding of various thermoplastic synthetic resins, and improvement of a structure of the body of the container made of synthetic resin adapted to be held with hands and fingers.

In general, in a conventional large containers of this type, distortion absorbent regions and reinforcing ribs are formed in a circumferential wall of the body in order to prevent the circumferential wall of the body from causing deformation due to increase/decrease of an internal pressure of the container, and a handle for holding the container is also provided to said circumferential wall of the body in order to facilitate the handling of the container.

However, said container-holding handle provided to the body has a problem, because a structure of the container comes to complex, an amount of a resin required to be used for each container increases, and because the handle affects deformation absorbent portion and facility of the circumferential wall of the body due to the increase/decrease of the internal pressure of the container, irrespective of the structure of the container manufactured either in a type of which the handle is integrally molded with the body or a type in which a separate handle is mounted to the container.

SUMMARY OF THE INVENTION

The present invention relates to a container having a body which has a left side and a right side, wherein each of the right and left sides has a region of a center of the body, which region is formed with a concaved portion for absorbing distortion of a circumferential wall of the body due to changes of an internal pressure of the container. The concaved portions in right and left sides are analogous or conformable in shape each other. Each of the concaved portions for absorbing distortion has a bottom wall in a form of a substantially shallowly concaved arc in at least one direction of a longitudinal direction and a lateral direction of the circumferential wall. Each of the concaved portions has an upper edge and a lower edge, and is formed with reinforcing portions adjacent to the upper and lower edges. Each of the reinforcing portions is protruded outwardly, and has a substantially triangular shape. Each of the reinforcing portions has a height and a lateral width. The height is gradually reduced from the circumferential surface of the body toward the bottom wall of the concaved portion. The lateral width is gradually reduced from the upper and lower edges toward the bottom wall.

The present invention also relates to a bottle-shaped container made of synthetic resin including a body having left and right sides which are symmetric to a central axis line of the container, wherein each of the right and left sides is formed with the concaved portion in a region including the center of the body, which concaved portion absorbs distortion due to changes in the internal pressure of the container. The concaved portions in right and left sides are analogous or conformable in shape each other, and have same dimensions. Each of said concaved portions includes an upper edge, a lower edge and a bottom wall. Said bottom wall is in a form of shallowly concaved arc in at least one direction of a longitudinal direction and a lateral direction of a circumferential wall of the body. Each of the concaved portion is formed with protruded reinforcing portions at an upper and lower portion thereof Each of the reinforcing portions has a height gradually reduced from the upper or lower edge to the bottom wall. Each of the reinforcing portions has a lateral width gradually reduced from the upper or lower edge to the bottom wall, so that the reinforcing portion has a substantially triangular shape.

The bottom wall of each of the concaved portions is formed with a protruded longitudinal rib which serves as a stopper for slipping of finger heads.

The bottom wall may be formed with a protruded lateral rib at a center thereof.

Since the container according to the present invention has the structure as described above, the container can be held surely with safeness by holding the approximately central portion of the body of the container with fingers and a palm of a single hand from either the front side or the rear side even if it has a large content and a heavy weight.

Further, since said concaved portion for absorbing distortion is configured in the above-described arc plane, it can perform the function similar to an end plate of a high-pressure resistant container. Thus, it can prevent deformation of the body of the container due to changes, of the internal pressure of the container, and large deformation of the container at the time of holding it from occurring. Furthermore, since the container according to the present invention does not require a handle, it is achievable to reduce a quantity of a resin to be used for manufacturing the container.

Still further, since it is no need to form a handle, a material resin to be used for the handle can be used for the container itself. Also, since there is no need to provide a protruded handle to the container, a space for storing the container can be reduced.

EMBODIMENTS

Figure 1:
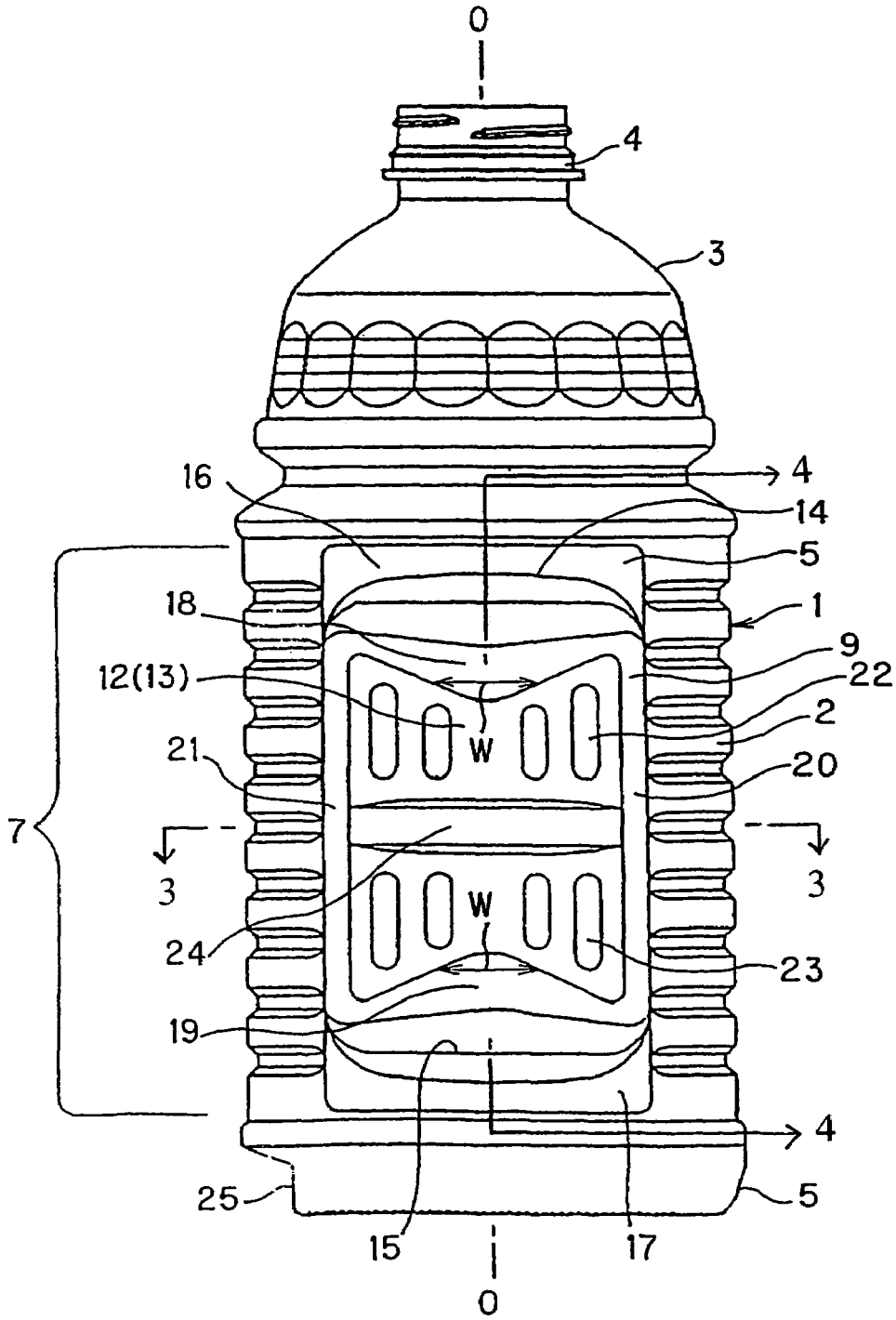
FIG. 1 is a right side view of a bottle-shaped container according to the present invention.

FIGS. 1 to 4 illustrate a bottle-shaped container made of PET resin with a content of 2 liters and formed by biaxially-oriented blow-molding according to one example of the present invention.

A container 1 shown in the drawings comprises a long cylindrical body 2, a shoulder 3 provided on the body, a neck 4 provided on the shoulder, and a bottom 5 provided under the body. The character or the feature of the present invention does not relate to the body, the shoulder, the neck and the bottom themselves, these structures may be similarly understood based on a known body, a known shoulder and a known neck of a container made of a synthetic resin, except the below described matters.

The body 2 has a left side 6A and a right side 6B which are symmetric to a central axis O—O of the container. The left side 6A is formed with a concaved portion 9 for absorbing distortion in a region 7 thereof including a center of the body. The right side 6B is formed with a concaved portion 10 for absorbing distortion in a region 8 thereof including the center of the body. An internal pressure in the container is decreased, if liquid or content having a high temperature is filled in the container, the neck is sealed, and then the temperature of the liquid is fallen. When the internal pressure is reduced, each of the concaved portions 9 and 10 can be bent inwardly, to thereby absorb and ease the deformation of the body wall.

The neck 4 may be thermally crystallized in order to fill the content having high temperature. The concaved portions 9 and 10 in the body are analogous each other, and the same in their dimensions. Each of the concaved portions 9 and 10 includes an upper edge 14, a lower edge 15, a left edge 20 and a right edge 21. In the illustrated example, each of the concaved portions 9 and 10 surrounded by the upper edge 14, the lower edge 15, the left edge 20 and the right edge 21 is formed in an elongated rectangular shape. However, there is no limitation for the shape of the concaved portion, and it may be formed in the other forms, for example, elliptic or the like.

Figure 3:
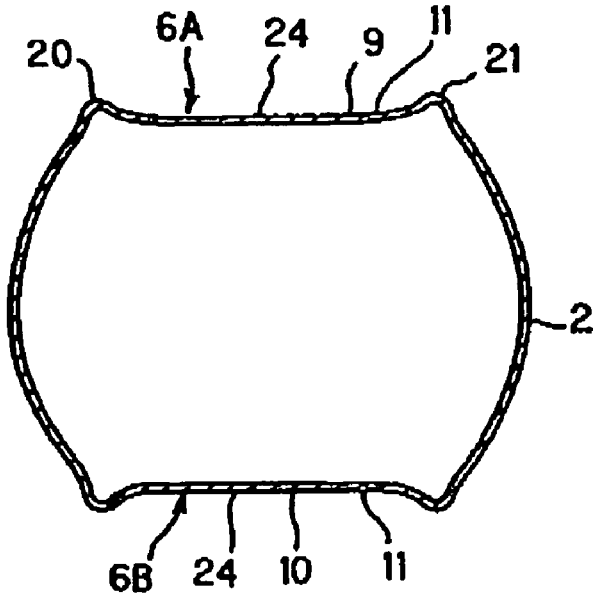
FIG. 3 is a cross sectional view cut along a line 3—3 shown in FIG. 1.
Figure 4:
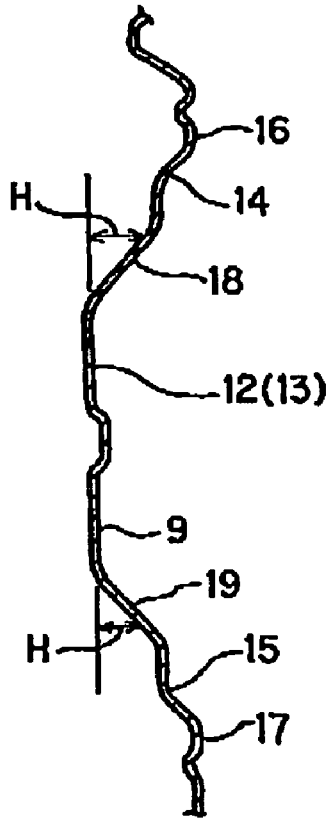
FIG. 4 is a longitudinal-sectional view cut along a line 4—4 shown in FIG. 1.

Each of the concaved portions 9 and 10 for absorbing distortion has a bottom wall 13. As shown in FIG. 3, the cross section of the bottom wall 13 is in a form of shallowly concaved arc 11. As shown in FIG. 4, the longitudinal section of the bottom wall 13 is in a form of a substantially flat 12.

Each of the concaved portions 9 and 10 is formed with reinforcing portions 18 and 19 adjacent to the upper edge 14 and the lower edge 15. Each of the reinforcing portions 18 and 19 has an approximately triangular shape, is protruded outwardly, and has a height H and lateral width W. The height H of each of the reinforcing portions 18 and 19 is gradually reduced from circumferential surfaces 16 and 17 of the body toward the bottom 13 of the concaved portion 9 or 10. The lateral width W of each of the reinforcing portions 18 and 19 is gradually reduced from the upper edge 14 or the lower edge 15 toward the bottom 13 of the concaved portion 9 or 10.

Each of the left edge 20 and the right edge 21 in the concaved portions 9 and 10 is a rib having a convex arc shape of the cross section. Each of the left edge 20 and the right edge 21 is arranged such that when an adult holds the body 2 of the container in the concaved portions 9 and 10 with a palm of a single hand, the palm between a carpal bone and a phalange bone is positioned in the concaved portion 9 or 10.

Each of the bottom walls 13 of the concaved portions 9 and 10 is formed with a plurality of longitudinal protruded ribs 22 and 23 with a low height, in order to prevent finger heads from slipping at holding.

Further, each of the bottom walls 13 is formed with a lateral protruded rib 24 in the center thereof.

A number of said longitudinal ribs 22 and 23 and a number of the lateral ribs 24 are not limited to the illustrated examples, and the shapes thereof is not limited to the illustrated shapes. Any shapes and the heights of the protrusion may be employed for the longitudinal ribs 22 and 23 as far as they can prevent the finger heads from slipping at holding. Any shapes and heights of the protrusion may be employed for the lateral rib 24 as far as it can reinforce the bottom wall 13 of the concaved portions 9, 10.

In the present invention, the bottom wall of the concaved portions 9, 10 is in the form of substantially shallowly concaved arc in at least one direction of the longitudinal direction and the lateral direction of the circumferential wall of the container. Further, outwardly protruded portions 18 and 19 are formed from each of the upper and lower edges 14 and 15 to the bottom wall 13 of each of the concaved portions 9, 10. Hence, each of the concaved portions 9 and 10 has a pressure-resistant strength same as that of an end plate of a high-pressure-resistant container. Accordingly, the concaved portions 9 and 10 retain strength enough to endure to changes in the internal pressure of the container and external pressure due to holding by a hand.

Although the container of the above-described example is made of PET resin, the material for the container is not limited to PET resin, and other polyester resins, polyolefin resins, polycarbonate resins and other known resins can be used to manufacture the container of the present invention. The container according to the present invention may have a structure of either monolayer or multilayer of the above-recited resins. For example, the container of this invention may be manufactured in a multilayer structure consisting of PET resin and an oxygen barrier material such as MDX-6 nylon resin and ethylene vinyl alcohol copolymer resin. Note that it is also possible to blend a known resin with said oxygen barrier material. Further, recycled PET resins and the like may be used for the same purpose.

Figure 2:
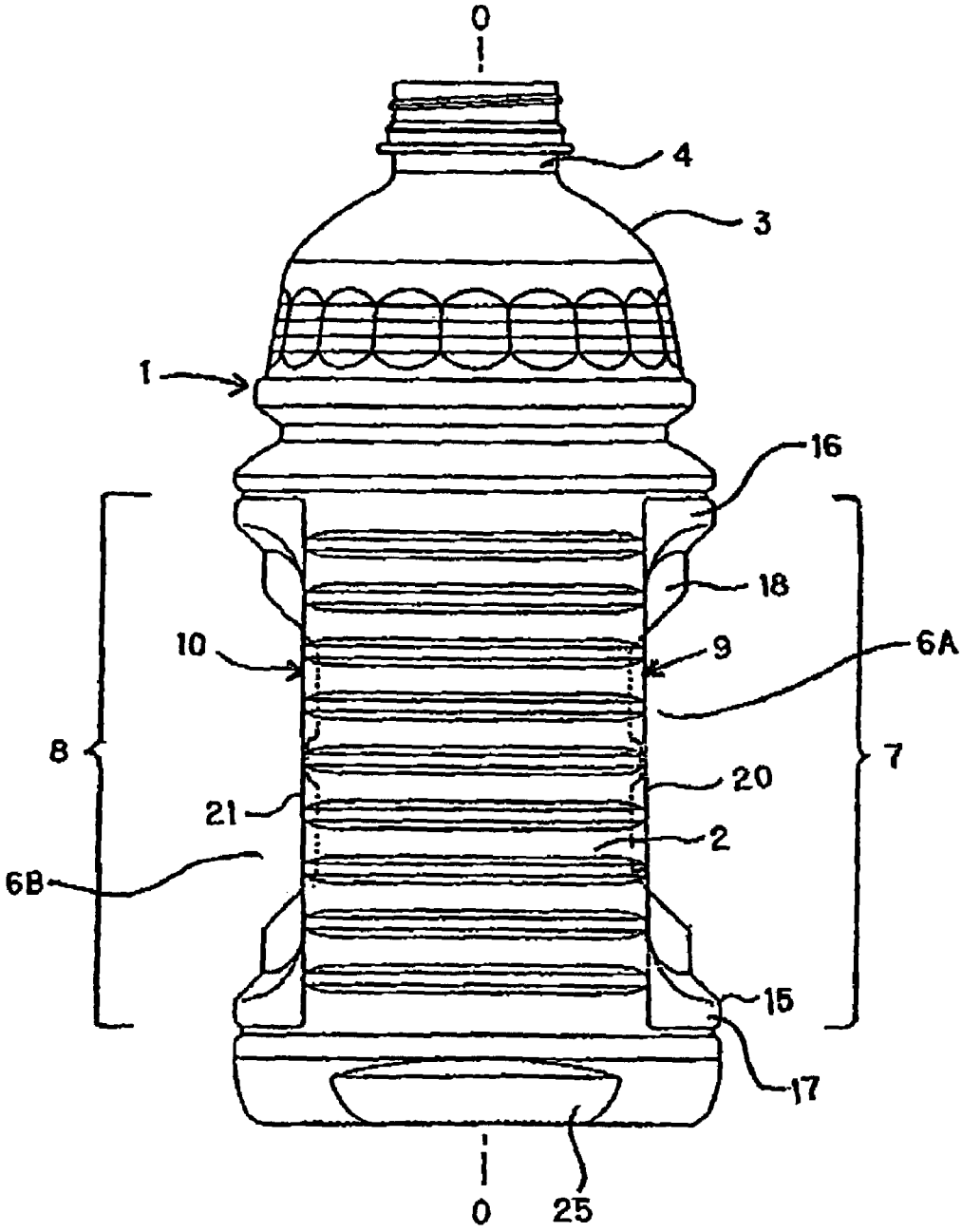
FIG. 2 is a front view of the bottle-shaped container shown in FIG. 1.

Note that, in the FIGS. 3 and 4, the thickness of the container is illustrated in the size magnified several times larger than the actual thickness of the wall, in order to show the structure distinctly, and the thickness of the wall does not directly affect the said strength. Further, the shape of the longitudinal cross section shown with a broken line in FIG. 2 is a sectional view when the bottle is cut along the line 4—4 shown in FIG. 1.

What is claimed is:

1. A bottle-shaped container made of synthetic resin including a body that has a left side and a right side which are symmetric to each other to a central axis line of the container, wherein each of the left and right sides is formed in a region including a center of the body, with a concaved portion configured to absorb distortion due to changes of an internal pressure of the container;

the concaved portions in the right and left sides are conformable in shape each other, and have same dimensions, each of said concaved portions includes an upper edge, a lower edge and a bottom wall, said bottom wall is in a form of shallowly concaved arc in at least one direction of a longitudinal direction and a lateral direction of a circumferential wall of the body, each of the concaved portion is formed with protruded reinforcing portions at to an upper and lower portion thereof, and each of the reinforcing portions has a height gradually reduced from the upper or lower edge to the bottom wall, and a lateral width gradually reduced from the upper or lower edge to the bottom wall, so that the reinforcing portion has a substantially triangular shape.

2. The container according to claim 1, wherein the bottom wall of each of the concaved portions is formed with a protruded longitudinal rib between the upper reinforcing portion and the lower reinforcing portion.

3. The container according to claim 2, wherein each of the concaved portions is bent inwardly when a temperature of a content is decreased to reduce an internal pressure of the container.

4. The container according to claim 2, wherein the bottom wall is formed with a protruded lateral rib, so that said protruded longitudinal rib is divided to two parts.

5. The container according to claim 4, wherein each of the concaved portions is bent inwardly when a temperature of a content is decreased to reduce an internal pressure of the container.

6. The container according to claim 2, wherein each of the concaved portions includes a left edge and a right edge, each of the left and right edges is a rib having a convex arc shape of the cross section, and each of the left edge and the right edge is arranged such that when an adult holds the body of the container in the concaved portions with a palm of a single hand, the palm between a carpal bone and a phalange bone is positioned in the concaved portion.

7. The container according to claim 6, wherein each of the concaved portions is bent inwardly when a temperature of a content is decreased to reduce an internal pressure of the container.

8. The container according to claim 1, wherein each of the concaved portions is bent inwardly when a temperature of a content is decreased to reduce an internal pressure of the container.

9. The container according to claim 8, wherein the container includes a neck which is thermally crystallized.

* * * * *